United States Patent [19]

Stock

[11] 4,408,699

[45] Oct. 11, 1983

[54] DISPENSING TIP FOR CYANOACRYLATE ADHESIVES

[75] Inventor: Hugh J. Stock, Saratoga, Calif.

[73] Assignee: Pacer Technology and Resources, Inc., Campbell, Calif.

[21] Appl. No.: 346,116

[22] Filed: Feb. 5, 1982

Related U.S. Application Data

[63] Continuation of Ser. No. 119,452, Feb. 7, 1980, abandoned.

[51] Int. Cl.[3] ..... B01L 3/00; B65D 1/08; B65D 17/24

[52] U.S. Cl. ..... 222/149; 222/420; 222/541; 222/546

[58] Field of Search ..... 222/153, 149, 182, 420, 222/545, 546, 562, 563, 215, 206, 541

[56] References Cited

U.S. PATENT DOCUMENTS

| | | | |
|---|---|---|---|
| 2,742,202 | 4/1956 | Dresden et al. | 222/541 |
| 2,761,598 | 9/1956 | Darlington, Jr. | 222/541 |
| 3,204,835 | 9/1965 | Michel | 222/541 |
| 3,227,332 | 1/1966 | Gowdy et al. | 222/525 |
| 3,858,739 | 1/1975 | Turner et al. | 222/541 X |
| 3,908,654 | 9/1975 | Lhoest et al. | 222/541 X |

FOREIGN PATENT DOCUMENTS

| | | | |
|---|---|---|---|
| 120904 | 2/1946 | Australia | 222/541 |
| 521237 | 5/1940 | United Kingdom | 222/420 |
| 793710 | 4/1958 | United Kingdom | 222/420 |

*Primary Examiner*—David A. Scherbel
*Attorney, Agent, or Firm*—Cahill, Sutton & Thomas

[57] ABSTRACT

A constant diameter passageway within a dispensing tip channels and dispenses a cyanoacrylate adhesive from a container through a discharge outlet at the extremity of the tip. A cap for the tip includes a plunger for matingly and penetrably engaging the passageway to force reverse flow of the cyanoacrylate adhesive back into the container. The forced flow, due to the viscosity and surface tension characteristics of the cyanoacrylate adhesive, initiates complete drainage of the passageway and prevents any crusting of the cyanoacrylate within the passageway and clogging of the passageway.

1 Claim, 4 Drawing Figures

DISPENSING TIP FOR CYANOACRYLATE ADHESIVES

This is a continuation of application Ser. No. 119,452 filed Feb. 7, 1980, abandoned.

The present invention relates to an invention described in copending U.S. patent application entitled "Child Proof Dispenser", Ser. No. 119,635, filed Feb. 7, 1980, now U.S. Pat. No. 4,334,638 describing an invention conceived and reduced to practice by the present inventor and which application is assigned to the present assignee.

The present invention relates to dispensers and, more particularly, to dispensing tips for fluids.

Cyanoacrylates adhesives have been used for a number of years for adhesively mating closely fitted components. A basis for selecting a cyanoacrylate adhesive in such applications in preference to some other adhesive is that the cyanoacrylate adhesive will wick or creep through tightly fitted joints before polymerizing and effecting a bond therebetween. Moreover, the volume of the resulting cured adhesive is essentially commensurate with the space between tightly fitting components and will not impede, dislodge or otherwise reposition or reorient the mated components.

One of the problems attendant any dispenser for cyanoacrylate adhesives is that of polymerization or crusting of the adhesive in proximity to the dispensing tip and discharge outlet. This problem is well recognized in U.S. Pat. No. 3,523,628; therein a spring loaded ball sealingly bears against the discharge outlet to evacuate the cyanoacrylate adhesive from within the outlet after dispensation of a quantity of cyanoacrylate adhesive.

In some dispensers for cyanoacrylate adhesives, the passageway has been flared from the discharge outlet toward the container itself in the belief that by having a large passageway diameter bridging of the cyanoacrylate adhesive across the passageway would be avoided and polymerization or crusting would be precluded. By experiments, it has become evident that crusting will still occur.

It is therefore a primary object of the present invention to provide a non-clogging dispensing tip for cyanoacrylate adhesives.

Another object of the present invention is to provide a self-draining tip for dispensing cyanoacrylate adhesives.

Yet another object of the present invention is to provide a container having a constant diameter passageway in a dispensing tip for dispensing cyanoacrylate adhesives.

Still another object of the present invention is to provide a plunger for initiating evacuation of any cyanocrylate adhesive from within the passageway and outlet of a dispensing tip.

A further object of the present invention is to provide a detachably attachable cap for evacuating and maintaining evacuated the passageway of a cyanoacrylate adhesive dispensing tip.

A yet further object of the present invention is to provide a flexibly resilient cap for sealingly engaging the dispensing tip of a cyanoacrylate dispenser.

A still further object of the present invention is to provide a cap and dispensing tip configuration which is fabricatable by molding processes as a single unit.

These and other objects of the present invention will become apparent to those skilled in the art as the description thereof proceeds.

The present invention will be described with greater specificity and clarity with reference to the following drawings, in which.

Figure 1:
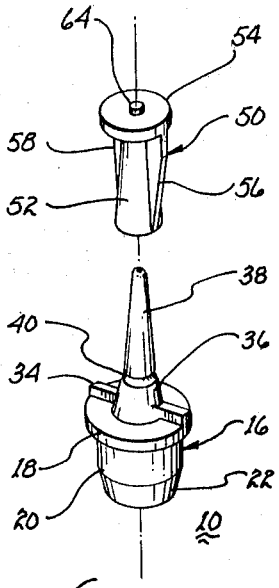
FIG. 1 is an isometric view of a dispensing tip and detachably attachable cap.
Figure 2:
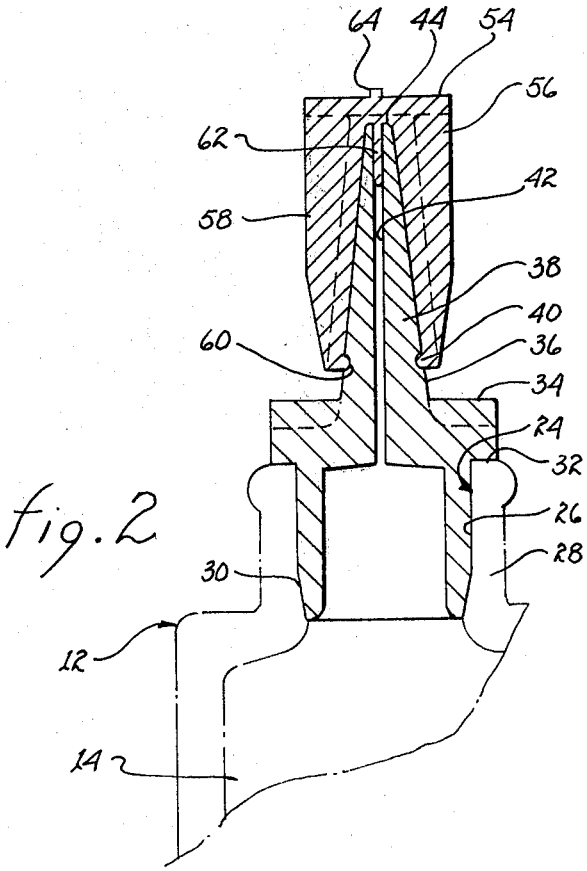
FIG. 2 is a cross-sectional view illustrating the capped dispensing tip.
Figure 3:
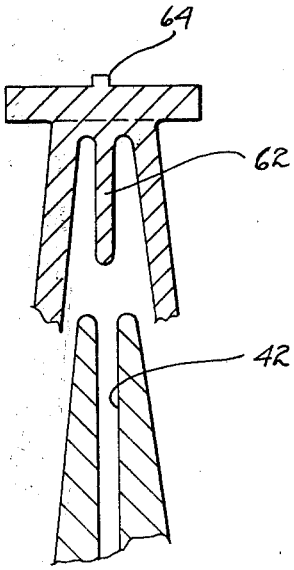
FIG. 3 is a partial cross-sectional view illustrating the mating of the cap with the dispensing tip.

Referring jointly to FIGS. 1 and 2, there is illustrated a dispensing tip 10 mountable upon a container 12. A quantity of cyanoacrylate adhesive 14 is disposed within the container for dispensation through the dispensing tip 10.

The dispensing tip includes a hollow boss 16 extending downwardly from a disk section 18. The boss includes a constant diameter cylindrical section 20 and a radially inwardly tapered section 22.

Container 12 includes a mouth 24 defined by an internal cylindrical surface 26 within cylindrical section 28 extending upwardly from the container. Cylindrical surface 26 is dimensioned to sealingly mate with and compressively engage cylindrical section 20 of dispensing tip 10 to form a tight seal therebetween. A truncated cone section 30 may be incorporated in cylindrical section 28 to sealingly mate with tapered section 22 of the dispenser tip. The upper end of cylindrical section 20 includes a planar annular section 32 serving as a seat for the annular under surface of disk section 18 of the dispensing tip.

To provide structural rigidity to disk section 18 and to provide a means for manually gripping the dispensing tip on installation of the dispensing tip in mouth 24 of container 12, a diametrically oriented ridge 34 is disposed upon the upper surface of disk section.

A centrally oriented base 36 is disposed upon disk section 18 and supports a tapered tip 38. An annular groove 40 is disposed at the junction of the base and the tapered tip. A passageway 42 extends from the interior of hollow boss 16 through base 36 and tapered tip 38 and terminates at discharge outlet 44. For reasons which will be discussed below, the cross-section of the passageway is circular and it is of constant diameter throughout its length.

A stopper 50 is formed by a hollow cone-shaped section 52, which section is internally configured to mate with the exterior surface of tapered tip 38. A disk 54 is disposed at the upper extremity of cone-shaped section 52. Positional rigidity of the disk with respect to the cone-shaped section is maintained by tapered flanges 56 and 58 disposed on opposed sides of the cone shaped section. Additionally, these flanges tend to restrain diametric expansion of the lower end of the cone-shaped section. An annular ridge 60 is disposed internal to the cone-shaped section and configured to mate with annular groove 40 in the manner of a detent. A plug 62 is centrally disposed within and extends downwardly from the internal apex of the cone-shaped section. The cross-sectional configuration of plug 62 essentially mates with the cross-sectional configuration of passageway 42. Thereby, upon insertion of plug 62 within the passageway, the plug serves in the manner of a plunger to force any matter therein downwardly through the passageway and into container 12.

By experimentation, it has been learned that evacuation of the cyanoacrylate adhesive within the passageway in a dispensing tip leading to the discharge outlet is a complex function of several variables, including propensity for rapid polymerization, surface tension, configuration of the passageway and the degree of surface energy of the material defining the passageway and discharge outlet. Initially, it was beleived that by having the passageway flare toward the container, bridging of the cyanoacrylate would be avoided and polymerization or crusting sufficient to clog the passageway would be constrained. Such is not the case.

Contrary to expectations of those skilled in the art, essentially total drainage of a cyanoacrylate adhesive will occur in a constant diameter passageway provided that forced gravity flow is initiated. To the extent presently understood, it is believed that this phenomenon is primarily a function of surface tension of the cyanoacrylate adhesive and that the surface tension, in combination with the other parameters discussed above will support continuing drainage after an initial flow is provided by means of a plunger or the like.

Accordingly, plug 62 is formed within stopper 50 to penetrably engage an upper part of passageway 42 on placement of the stopper upon the dispensing tip. The initial insertion of the plug within the passageway will initiate forced downward flow of any cyanoacrylate adhesive coming in contact therewith. The initial downward flow, on comingling with any further cyanoacrylate adhesive in the remainder of the passageway will, by means of what is believed to be an "avalanche" effect, initiate and maintain essentially complete drainage of the cyanoacrylate adhesive from the passageway back into the container.

As may be deduced from the above description of the structure of stopper 50 and dispenser tip 10, engagement of ridge 60 with groove 40 will maintain the stopper attached to the dispensing tip to prevent inadvertent opening of passageway 42 by withdrawal plug 62. Additionally, the combined effect of plug 62 mating with passageway 42, tapered tip 38 mating with the interior cone-shaped surface of cone-shaped section 52 and ridge 60 mating with groove 40 will provide an air tight or near air tight seal to prevent flow of fluid, whether cyanoacrylate adhesive or air, into and out of container 12.

Figure 4:
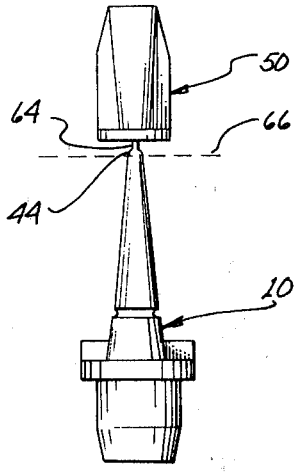
FIG. 4 is a side view of a dispensing tip having a severably attached cap.

As particularly illustrated in FIG. 4, dispensing tip 10 and stopper 50 may be manufactured by molding processes as a single unit. By employing such molding techniques, the number of units that must be handled in fabrication and assembly is reduced by one half, which brings about handling, storage and assembly economies. Preferably, stopper 50 is molded to be attached to dispensing tip 10 by means of a land 64 or similar segment extending from the center of disk 54 to the closed end of tapered tip 38. The stopper and dispensing tip are severed from one another by effecting a cut along dashed line 66. Such a cut not only severs the two components but exposes passageway 42 and defines discharge outlet 44. The land remaining attached to disk 54 (as illustrated in FIG. 1) is of no import and need not be removed.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A dispensing tip attachable to the mouth of a container of cyanoacrylate adhesive for dispensing the cyanoacrylate adhesive, said dispensing tip comprising in combination:

(a) a disk section supporting an hollow boss for sealingly and internally engaging the mouth of the container;

(b) a conical tip extending from said disk section for dispensing the cyanoacrylate adhesive;

(c) a diametrically oriented ridge extending from said disk section and from opposed sides of said conical tip for providing a gripping surface upon installation of said conical tip within the mouth of the container;

(d) a constant diameter passageway extending through said conical tip from said hollow boss and terminating at a discharge outlet to provide fluid communication between the interior of the container and the discharge outlet; and (e) a stopper detachably attached to the end of said conical tip for hermetically sealing said passageway prior to detachment of said stopper from said conical tip, said stopper including: a disk extending radially at the extremity of said conical tip, an inverted conical shroud extending from the center of said disk, said conical shroud including a cavity having an interior conical surface for receiving said conical tip and a plug enclosed within said cavity for engaging said passageway on mounting of said stopper upon said conical tip to force flow of any residual cyanoacrylate adhesive within said passageway into the container, and a pair of flanges disposed upon opposed sides of said shroud and joined to said disk for providing an enlarged surface area to grip said stopper and which grip is restrained from sliding by said disk.

* * * * *